United States Patent [19]

Kenrick

[11] Patent Number: 4,619,103

[45] Date of Patent: Oct. 28, 1986

[54] ASSEMBLY METHOD AND APPARATUS

[76] Inventor: C. Robert Kenrick, 17850 Hiawatha, Spring Lake, Mich. 49456

[21] Appl. No.: 519,502

[22] Filed: Aug. 2, 1983

[51] Int. Cl.[4] ..... B65B 31/02

[52] U.S. Cl. ..... 53/432; 53/436; 53/510; 53/527

[58] Field of Search ..... 53/432, 436, 438, 439, 53/510, 523, 527; 100/233

[56] References Cited

U.S. PATENT DOCUMENTS

| | | | |
|---|---|---|---|
| 3,195,448 | 7/1965 | Larsen et al. | 53/527 X |
| 3,218,778 | 11/1965 | Moreland | 53/527 |
| 3,499,261 | 3/1970 | Hullhorst et al. | 53/438 X |
| 3,939,622 | 2/1976 | Murphy et al. | 53/436 |
| 4,183,295 | 1/1980 | Peterson | 100/233 X |
| 4,235,063 | 11/1980 | Paetz | 53/527 X |

FOREIGN PATENT DOCUMENTS

| | | | |
|---|---|---|---|
| 1324212 | 7/1973 | United Kingdom | 53/527 |

*Primary Examiner*—Robert L. Spruill
*Assistant Examiner*—Steven P. Weihrouch
*Attorney, Agent, or Firm*—Price, Heneveld, Huizenga & Cooper

[57] ABSTRACT

Compression packaging of flexible hose into a packaging container using an elongated peripherally closed housing supporting and surrounding an elongated section of flexible hose. A piston is placed at one end of the housing in peripherally sealed relation to the housing. A packaging container is placed at the second end of the housing. Suction is applied at this second end of the housing to create a pressure differential across the piston without creating a pressure differential across the hose wall, causing the piston to travel the length of the housing for axial compression of the hose into the packaging container.

9 Claims, 4 Drawing Figures

ASSEMBLY METHOD AND APPARATUS

BACKGROUND OF THE INVENTION

This invention relates to assembly packaging, and more particularly to compression packaging of flexible duct.

Flexible duct used for transfer of heated or cooled air or other gases is typically designed for low pressure usage, e.g. about 3 to 5 inches of water pressure. The hose or duct is normally composed of an inner liner reinforced by a helical strand as of metal or plastic, a thick layer of flexible insulation such as fibrous glass around the liner, the insulation being surrounded by a flexible plastic, i.e. polymeric, jacket. As is well known, shipping, handling and storage costs and convenience are substantially improved by axially compressing the flexible duct into a small container, typically an elongated box, having a length only a small fraction of the initial hose length in its free state. Compressing smaller diameter hose can be very troublesome. Because the thickness of insulation normally does not vary considerably with variation of hose diameter, the ratio of insulation thickness to total hose diameter increases greatly for smaller diameter hose, e.g. being about 50% for a typical 5 inch diameter hose. Axial compression of this type of structure having such a large ratio of material by prior techniques and equipment is difficult at best, especially in the final stages of compression, with potential damage occurring to the hose as well as collapsed hose preventing full compression into the container.

One prior technique for compressing the flexible hose for packaging is simply manually performing the operation. Another prior technique is by placing a closure over one open end of the hose and applying suction into the opposite end of the hose, to cause the hose to axially collapse toward the source of suction. In the final stages of this operation, it is not unusual to have to pull a pressure differential of 80 or even 100 inches of water pressure on the hose. This can result in damage to the hose. Moreover, the hose will too often radially collapse in one or more areas. This radial collapse, aside from the potential hose damage it might cause, results in the axial compression of the hose being prematurely stopped when the collapsed area reaches the packaging container, rendering it difficult at best to stuff the remaining hose portions, i.e. between the collapsed area and the plugged end of the hose, into the container.

SUMMARY OF THE INVENTION

The present invention achieves axial compression of flexible hose or duct, using suction or vacuum, but without a pressure differential being created across the wall of the flexible duct. Thus the hose is not subject to damage by such a pressure differential. Neither does the hose radially collapse during the axial compression operation in the absence of such a pressure differential.

Use of the invention has also demonstrated its capacity to employ packaging containers approximately 28% or so smaller in size, as a result of more uniform and effective axial compression as compared to known prior techniques. This considerable saving is even achieved at greater productivity rates than previously experienced.

The invention also encompasses the capacity of effecting, during the packaging operation, assembly of a second section of flexible hose using the force of the packaging device, this second section then ending in proper position to be packaged with the next stroke of the apparatus.

The apparatus employs an elongated vacuum housing to receive the duct, a piston movable the length of this housing in peripherally sealed relation thereto, in response to pressure differential thereon, a vacuum source at the end of the housing to create the pressure differential, and a sealed box receiving chamber to receive the hose compressed by the piston. The piston is stopped after full compression, and latched against reversing. Preferably, the layers of a second duct are assembled by force of the moving piston simultaneously with compression packaging of the first duct.

These and other features, objects and advantages of the invention will be apparent from a study of the following description taken in conjunction with the drawings.

DETAILED DESCRIPTION OF THE PREFERRED EMBODIMENT

Referring now specifically to the drawings, the assembly 10 constitutes apparatus for compressing and packaging, and optionally for forming, elongated flexible duct. Such flexible duct or hose typically includes an inner liner as of plastic, reinforced by a helical strand, a thick layer of flexible compressible insulation such as fibrous glass around the liner, surrounded by a polymeric or plastic skin or jacket. The apparatus 10 includes the compression and packaging assembly 12 and, optionally forming and support assembly 14.

Figure 1:
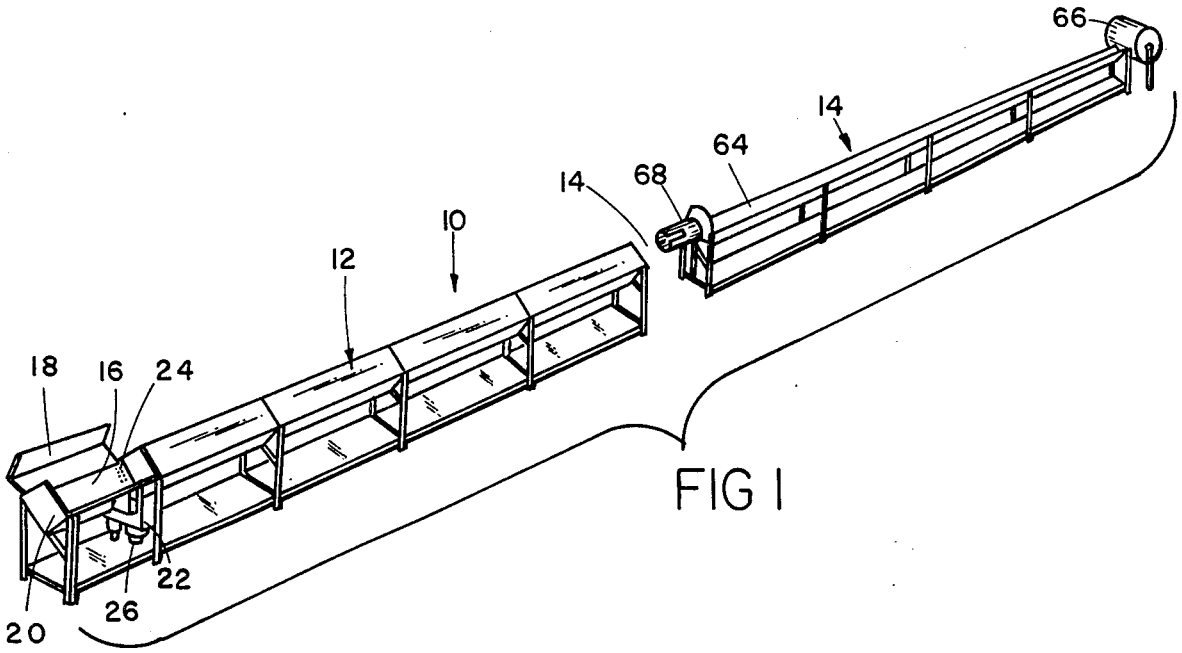
FIG. 1 is a perspective view of the apparatus of this invention, the packaging apparatus being on the left, and the layup support apparatus for assembly of flexible hose being on the right.
Figure 2:
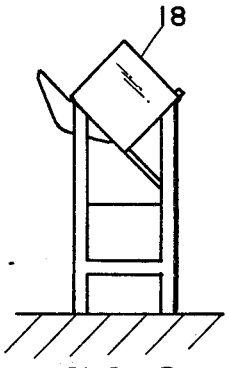
FIG. 2 is an end elevational view of the apparatus in FIG. 1 taken from the left end.

Assembly 12 includes an elongated vacuum housing shown to be basically square in cross section although other configurations may be employed. It is preferably made of sections sealingly interconnected to achieve the desired overall length. One end 14 of this housing is open to the ambient atmosphere. The second and opposite end of this housing may be opened or closed as with a hinged cover 18 movable between an open position (FIG. 1) and a closed position (FIG. 2). End panel 20 completes the closure. When so closed, the cover forms a seal with the underlying trough, the adjacent segment of the housing, and said end panel, to close off this end of the housing. The resulting chamber 16 receives an elongated container such as a cardboard box B for packaging the flexible duct.

Also adjacent this downstream, i.e. second end of the housing is a vacuum chamber 22 which communicates through orifices 24 with the interior of the vacuum housing. One or more conventional vacuum pumps 26 may be mounted immediately adjacent this vacuum chamber or at a remote location in communication therewith.

A piston subassembly 30 cooperates with this vacuum housing. The piston head 32 is configurated and dimensioned comparable to the interior of the housing to move therealong in sealed relationship thereto. It is shown here to have a square configuration to match the square configuration of the housing. The piston has a peripheral seal 34 which sealingly engages the inner periphery of the vacuum housing, an inner axial surface area 36, and an outer axial surface area 38.

Projecting inwardly from the piston head is a piston guide 40 forming a part of the piston subassembly, preferably including a roller 42 along the lower portion thereof for minimizing friction relative to the housing and for maintaining piston alignment during movement of the piston from the first end to the second end of this housing. A reflector 44 on the guide may be used to reflect a light beam projected into the vacuum housing at the second end thereof to actuate a photo switch and thereby electronically deactuate the vacuum pump when the piston reaches the end of its stroke at the second end of the housing. Also extending from the piston guide is a mechanical trip latch here shown in the form of an extensible tube 48, to latch the piston in position against return movement at the end of its stroke. Thus, when the vacuum is released, the piston is latched against reverse movement under the bias of the compressed duct.

Figure 3:
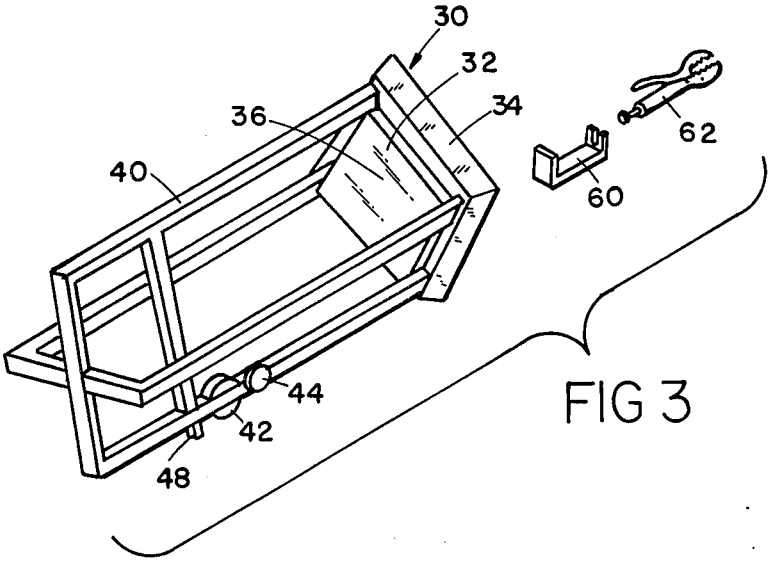
FIG. 3 is an enlarged perspective view of the piston and its guide of the apparatus.
Figure 4:
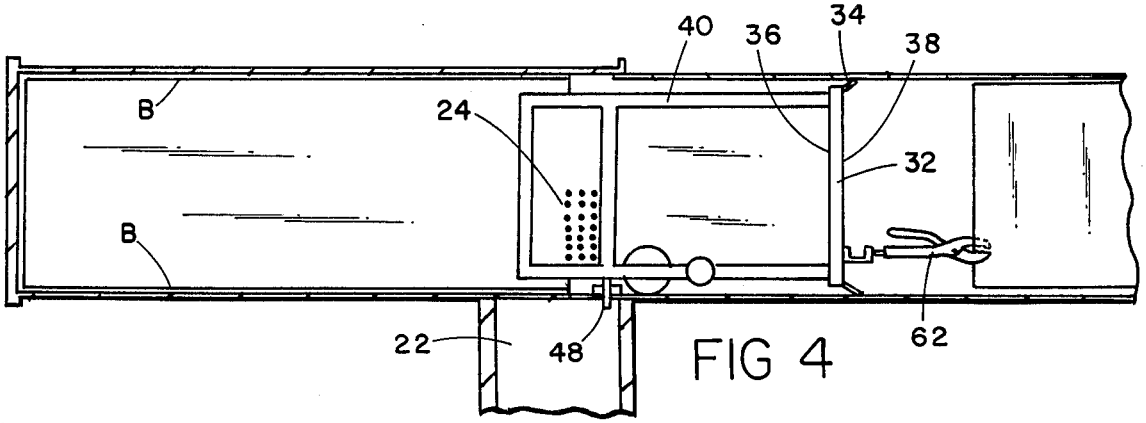
FIG. 4 is a sectional elevational view of the left end portion of the apparatus in its final stage of axial hose compression and packaging.

Optionally, the outer axial face of the piston includes a bracket 60 (FIG. 3) here shown in exploded view to be removed from the piston, for securing a gripper 62. This gripper can be employed to cause assembly of the next flexible tube section with piston advancement during packaging of a previously formed section, utilizing the apparatus of assembly 14. This assembly includes an elongated support trough 64 extending from a supported supply of insulation stock 66, such as a roll, at one end of the trough, to a forming nose cone or funnel 68 of conventional type at the discharge end of the trough. Assembly of the three layers, namely the liner, the insulation carcass, and the jacket is achieved by pulling all three with gripper 62 as explained more fully hereinafter.

In operation, compression and packaging of the flexible duct or hose using the assembly 12 occurs as follows. With the elongated section of the flexible duct positioned inside the elongated vacuum housing 12, a packaging box is placed in chamber 16 with the open end of the box facing the flexible hose and its closed end abutted against fixed end panel 20. Cover 18 is closed and thereby sealed, piston subassembly 30 is inserted, guide first, in the open end 14 of the housing, and vacuum is applied to the entire vacuum housing, both inside and outside of the flexible hose, by activating the vacuum pump to vacuum chamber 22 and orifices 24. The resulting pressure differential is only across the piston head, with its outer axial surface area 38 exposed to ambient pressure. No significant pressure differential occurs across the wall of the duct. The resulting force on the piston causes the piston to be propelled to advance from end 14 toward chamber 16. This advancement axially compresses the flexible duct ahead of the piston without exposing the walls of the duct to the potential damage due to any pressure differential thereacross, forcing the duct uniformly into the box. Compression terminates when piston subassembly 30 reaches the second end of the housing so that reflector 44 reflects a light beam for deactuation of the vacuum, and trip latch 48 latches the piston subassembly against return movement in the housing. When the vacuum pump stops, air enters the housing to release the vacuum, cover 18 is lifted, the open end of the box or carton containing the duct is closed, the box is removed, the piston is physically lifted from the housing and returned to the first end 14 for the next run, an empty box is placed in chamber 16, and cover 18 is again closed. The apparatus is then ready for the next cycle.

If the assembly apparatus 14 is also employed, the following steps are also performed. Insulation is pulled from the roll 66 until its leading edge is adjacent the funnel mouth of nose cone 68. The tail end of the insulation is cut off so that the insulation is then of the proper length for the duct section to be formed. Next a cylindrical sleeve of liner of the same length is laid on the length of insulation, and the two are pushed down in the trough. Also, a cylindrical jacket as of extruded polymer is applied to the cylindrical discharge end of forming funnel 68 in corrugated condensed form comparable to a person's stocking about to be pulled on. Then, the leading edges of the insulation and liner are pulled through the funnel, and these plus the leading edge of the jacket are gripped by gripper 62 attached to piston 34. Thus, at the time the piston subassembly is placed in the open end 14, the leading edges of the liner and insulation are pulled through the funnel, the leading edge of the jacket is pulled off the discharge end of the funnel, and all three are clamped in gripper 62 which is attached to the piston. The vacuum source is again activated to cause piston travel for compression of the flexible hose section in housing 12. Simultaneously, the liner and insulation are progressively pulled through funnel 68 while the jacket is pulled off the funnel exterior, to collectively form the next section of hose. Moreover, at the end of the stroke, this next section will be properly positioned within vacuum housing 12 for subsequent compression and packaging thereof on the succeeding stroke.

It will be realized that the particular configuration of the apparatus as well as certain details of construction and control may be modified to suit a particular installation or forming method. The invention is intended to be limited therefore not particularly to the specific embodiment set forth as illustrative, but only by the scope of the appended claims and the reasonable equivalents to the invention defined therein.

The embodiments of the invention in which an exclusive property or privilege is claimed are defined as follows:

1. Packaging apparatus for compressing into a container, an elongated flexible duct having a length initially many times greater than the length of said container, comprising:

an elongated vacuum housing having a length sufficient to receive the flexible duct, said vacuum housing including first and second ends; a piston movable in said vacuum housing between said first and second ends, in peripherally sealed relationship to said vacuum housing, and having an inner axial surface area and an outer axial surface area; said piston outer axial surface area being exposed to ambient pressure outside of said housing; a container receiving chamber at said second end of said vacuum housing, for removably receiving a packaging container; suction means in communication with said second end of said vacuum housing, for applying negative pressure upon said inner axial piston surface area and in said housing while maintaining like pressure upon the inner and outer walls of a flexible duct in said housing, to cause said piston to be propelled by pressure differential toward said chamber and a container therein and thereby compress the flexible duct into said container free of significant pressure differential across the wall surface of the duct.

2. The apparatus in claim 1 including an access door to said chamber for insertion of an empty container and removal of a filled container when said door is open, said door being sealed to said housing when closed.

3. Apparatus in claim 1 wherein said piston includes an elongated alignment body projecting in front thereof.

4. Apparatus of claim 3 including a roller between said body and said housing.

5. Apparatus of claim 3 wherein said body includes means for deactuation of said suction means when said body reaches said chamber.

6. Apparatus of claim 1 including latch means for latching said piston against return movement after said piston is propelled to said chamber.

7. Assembly and packaging apparatus for flexible duct comprising:

an elongated vacuum housing having a length sufficient to receive the flexible duct, said vacuum housing including first and second ends; a piston movable in said vacuum housing between said first and second ends, in peripherally sealed relationship to said vacuum housing, and having an inner axial surface area and an outer axial surface area; said piston outer axial surface area being exposed to ambient pressure outside of said housing; a container receiving chamber at said second end of said vacuum housing, for removably receiving a packaging container; suction means in communication with said second end of said vacuum housing, for applying negative pressure upon said inner axial piston surface area and in said housing while maintaining like pressure upon the inner and outer walls of a flexible duct in said housing, to cause said piston to be propelled by pressure differential toward said chamber and a container therein and thereby compress the flexible duct into said container free of significant pressure differential across the wall surface of the duct; gripper means on said piston for gripping layers of material for forming another section of flexible duct and moving with said piston; support means and funnel shaped forming means for the layers of material adjacent said first end of said vacuum housing, whereby when said piston is propelled in said vacuum housing, another section of duct will be formed.

8. A method of packaging flexible hose comprising the steps of:

supporting an elongated section of flexible hose in an elongated housing; placing a movable piston in one end of said housing in peripherally sealed relationship to said housing; placing a packaging container in the second end of said housing to receive the flexible hose; applying suction to said second housing end, both inside and outside of said flexible hose, to cause a pressure differential across said piston without creating a pressure differential across the hose, and thereby causing said piston to travel from said first housing end to said second housing end for axial compression of said flexible hose into said packaging container.

9. The method in claim 8 including the steps of attaching materials for forming another section of flexible hose to said piston to travel therewith; causing said materials to pass a former; and causing said materials to advance past said former with said piston travel to form another flexible hose section simultaneously with packaging of the first mentioned section.

* * * * *